US012654808B2

(12) United States Patent
Rouhi

(10) Patent No.: US 12,654,808 B2
(45) Date of Patent: Jun. 16, 2026

(54) WATERCRAFT ASSEMBLY FROM REPURPOSED AIRCRAFT

(71) Applicant: Javid Rouhi, Springfield, VA (US)

(72) Inventor: Javid Rouhi, Springfield, VA (US)

( * ) Notice: Subject to any disclaimer, the term of this patent is extended or adjusted under 35 U.S.C. 154(b) by 438 days.

(21) Appl. No.: 18/382,443

(22) Filed: Oct. 20, 2023

(65) Prior Publication Data

US 2024/0166307 A1 May 23, 2024

Related U.S. Application Data

(60) Provisional application No. 63/427,768, filed on Nov. 23, 2022.

(51) Int. Cl.

| | |
|---|---|
| ***B63B 3/04*** | (2006.01) |
| ***B63B 27/14*** | (2006.01) |
| ***B63B 27/22*** | (2006.01) |
| ***B63B 73/10*** | (2020.01) |

(52) U.S. Cl.

CPC ..... *B63B 3/04* (2013.01); *B63B 27/14* (2013.01); *B63B 27/22* (2013.01); *B63B 73/10* (2020.01)

(58) Field of Classification Search

CPC .. B63B 3/00; B63B 3/04; B63B 73/00; B63B 73/10; B63B 27/00; B63B 27/14; B63B 27/22; B63B 29/00; B63B 29/02; B64C 35/00; B64C 35/006; B64C 25/00

USPC ..... 114/61.2; 244/105

See application file for complete search history.

(56) References Cited

U.S. PATENT DOCUMENTS 3,190,582 A * 6/1965 Lippisch ..... B64C 35/006 244/105

7,552,895 B2 * 6/2009 From ..... B64C 35/006 244/105

FOREIGN PATENT DOCUMENTS

JP 2010064697 A * 3/2010 ..... B64C 25/54

* cited by examiner

*Primary Examiner* — Lars A Olson

(74) *Attorney, Agent, or Firm* — IP Consulting Group; Michael Razavi; Alfred F Hoyte, Jr.

(57) ABSTRACT

A watercraft assembly is provided. The watercraft assembly includes a fuselage extracted from a used aircraft, wherein the fuselage has a base that is configured to be disposed above a waterbody. The watercraft assembly further include a plurality of coupling members coupled to the base of the fuselage. The plurality of coupling members is equally distributed on opposing sides of the fuselage and each coupling member includes a staircase that is aligned towards a first axis, which is perpendicular to a longitudinal axis of the fuselage. The watercraft assembly further include a plurality of side vessels coupled to the plurality of coupling members. Each side vessel of the plurality of side vessels may be configured to be disposed on the waterbody and bear a weight of the fuselage above the waterbody, via the plurality of coupling members.

20 Claims, 4 Drawing Sheets

WATERCRAFT ASSEMBLY FROM REPURPOSED AIRCRAFT

TECHNICAL FIELD

The present disclosure relates to a watercraft assembly. More particularly, the present disclosure relates to a system and a method to form the watercraft assembly from a repurposed aircraft.

BACKGROUND OF THE INVENTION

The following description includes information that may be useful in understanding the present invention. It is not an admission that any information provided herein is prior art or relevant to the presently claimed invention.

Aircraft is generally disposed based on usage after a certain period. In some cases, few components (for example, wheels, wings, etc.) of the used aircraft may be salvaged to construct other devices (for example, a renewed aircraft, or other devices). However, some components of the used aircraft may not be salvaged due to their heavy size, leakage, and rust overtime. For example, some components, such as a fuselage of the used aircraft may have an increased size, and prone to rust overtime. Hence, disposal of such components of the used aircraft may be difficult.

The present disclosure is directed to overcome one or more limitations stated above or any other limitations associated with the prior art.

SUMMARY OF THE INVENTION

The following presents a simplified summary to provide a basic understanding of some aspects of the disclosed watercraft assembly. This summary is not an extensive overview and is intended to neither identify critical elements nor delineate the scope of such elements. Its purpose is to present some concepts of the described features in a simplified form as a prelude to the more detailed description that is presented later.

An exemplary aspect of the disclosure provides a watercraft assembly. The watercraft assembly may include a fuselage extracted from a used aircraft, wherein the fuselage has a base that is configured to be disposed above a waterbody. The watercraft assembly may further include a plurality of coupling members coupled to the base of the fuselage. The plurality of coupling members is equally distributed on opposing sides of the fuselage and each coupling member includes a staircase that is aligned towards a first axis, which is perpendicular to a longitudinal axis of the fuselage. The watercraft assembly may further include a plurality of side vessels coupled to the plurality of coupling members. Each side vessel of the plurality of side vessels is aligned towards a second axis, which is parallel to the longitudinal axis of the fuselage. Each side vessel of the plurality of side vessels may be configured to be disposed on the waterbody and bear a weight of the fuselage above the waterbody, via the plurality of coupling members.

Another exemplary aspect of the disclosure provides a watercraft assembly. The watercraft assembly may include a fuselage extracted from a used aircraft. The fuselage may have a base that is configured to be disposed above a waterbody. The watercraft assembly may further include a plurality of coupling members coupled to a base of the fuselage, wherein the plurality of coupling members is equally distributed on opposing sides of the fuselage and each coupling member includes a staircase that is aligned towards a first axis, which is perpendicular to a vertical axis of the fuselage. The watercraft assembly may further include a plurality of side vessels coupled to the plurality of coupling members, wherein each side vessel of the plurality of side vessels is aligned towards a second axis, which is parallel to the vertical axis of the fuselage.

Another exemplary aspect of the disclosure provides a method to form a watercraft assembly.

The method may include forming a fuselage extracted from a used aircraft. The fuselage has a base that is configured to be disposed above a waterbody. The method may further include coupling a plurality of coupling members to a base of the fuselage. The plurality of coupling members is equally distributed on opposing sides of the fuselage and each coupling member includes a staircase that is aligned towards a first axis, which is perpendicular to a vertical axis of the fuselage. The method may further include coupling a plurality of side vessels to the plurality of coupling members, wherein each side vessel of the plurality of side vessels is aligned towards a second axis, which is parallel to the vertical axis of the fuselage.

It is to be understood that the aspects and embodiments of the disclosure described above may be used in combination with each other. Several of the aspects and embodiments may be combined to form a further embodiment of the disclosure.

The above summary is provided merely for the purpose of summarizing some example embodiments to provide a basic understanding of some aspects of the disclosure. Accordingly, it will be appreciated that the above-described embodiments are merely examples and should not be construed to narrow the scope or spirit of the disclosure in any way. It will be appreciated that the scope of the disclosure encompasses many potential embodiments in addition to those here summarized, some of which will be further described below.

OBJECTS OF THE INVENTION

The main object of the present disclosure is to form a watercraft assembly from a used aircraft.

Another object of the present disclosure is to provide a watercraft assembly formed from a used aircraft, which is configured to float above a waterbody.

Effects/Advantages of the Present Invention

The main advantage of the present disclosure is repurposing of the used aircraft to a usable watercraft. Details of such watercraft are described further, for example, in FIG. 1.

BRIEF DESCRIPTION OF THE DRAWINGS

The accompanying drawings, which are incorporated in and constitute a part of this disclosure, illustrate exemplary embodiments and, together with the description, explain the disclosed principles.

DETAILED DESCRIPTION

Exemplary embodiments are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed embodiments. It is intended that the following detailed description be considered as exemplary only, with the true scope and spirit being indicated by the following claims. Additional illustrative embodiments are listed below.

Figure 1:
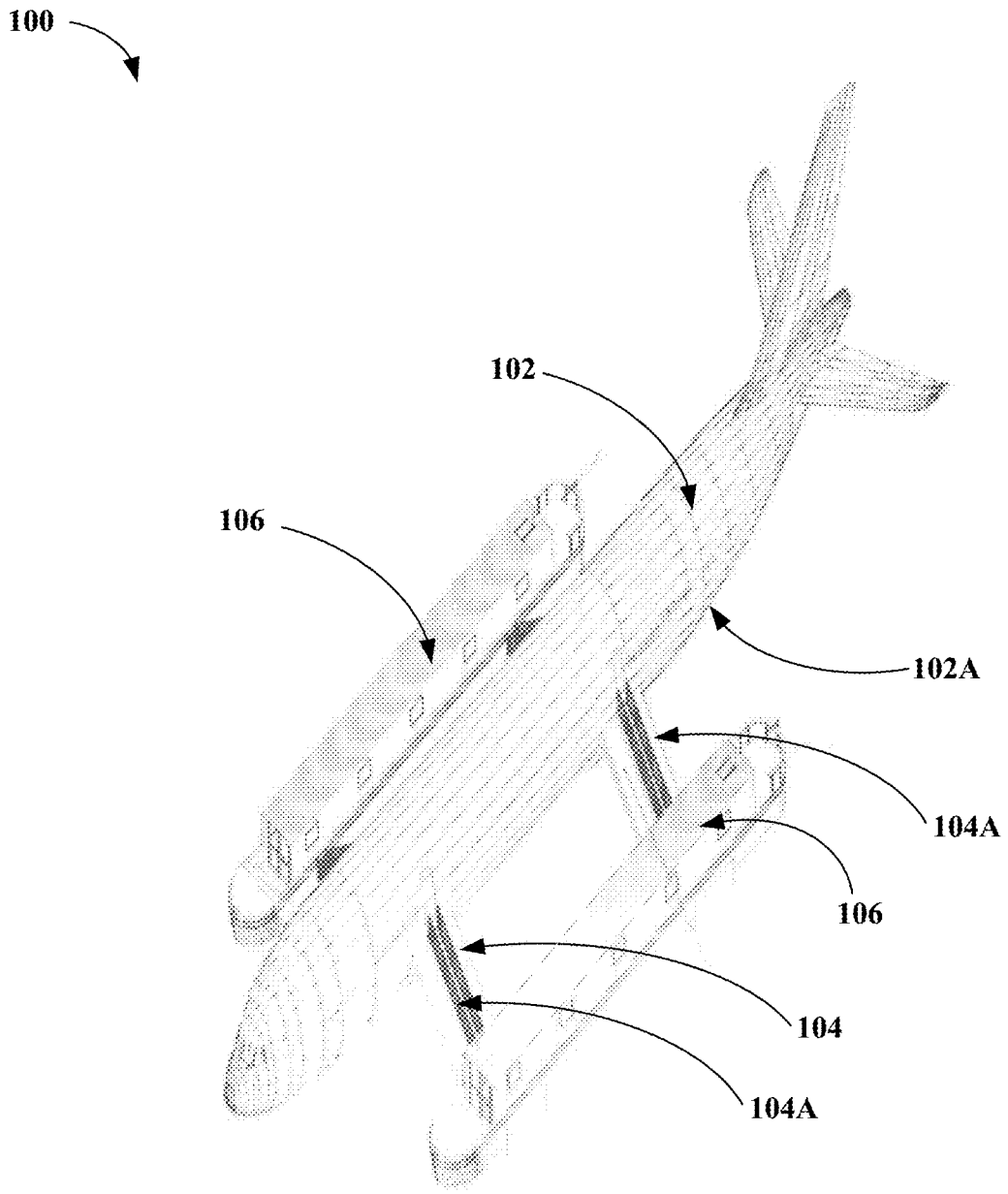
FIG. 1 illustrates a perspective view of a watercraft assembly, in accordance with an embodiment of the disclosure.

FIG. 1 illustrates a perspective view of a system to form the watercraft assembly, in accordance with an embodiment of the disclosure. With reference to FIG. 1, there is shown a perspective view of a watercraft assembly 100. The watercraft assembly 100 may include a fuselage 102, a plurality of coupling members 104, and a plurality of side vessels 106.

The fuselage 102 may be extracted from a used aircraft (not shown), wherein the fuselage has a base 102A that is configured to be disposed above a waterbody (not shown). In an embodiment, the base 102A of the fuselage 102 may be coated with a rust resistance coating material to avoid potential erosions of the fuselage 102 against the waterbody. In an embodiment, the fuselage 102 may be disposed at a first height from a base level of the waterbody.

The fuselage 102 is extracted from a medium to large sized used commercial passenger aircraft. The fuselage 102 may be typically configured to hold crew, passengers, cargo, an array of aircraft systems and sometimes fuel. In an embodiment, the fuselage 102 may include a seating arrangement to accommodate occupants in the fuselage 102. The fuselage 102 may typically include a plurality of seats for occupants and pavement spaces for the occupants in the fuselage 102. The fuselage 102 may be designed based on a seating capacity, facilities for the occupants, and an ergonomic comfort level of the occupants of the fuselage 102. These aircraft are typically optimized for maximum seating except in the first-class area which may, depending upon the size of the aircraft have a lounge area. In another embodiment, the fuselage 102 may include a vacant space in addition to the seating arrangement to accommodate movement of the occupants in the fuselage 102. Preferably, some seats would be removed from the fuselage 102 so as to provide space for passengers to lounge as is typical for decks on a large vessel.

In an embodiment, the fuselage 102 may be formed by removing the wings from the aircraft, which typically requires removing the jet engines as well. Seats and other components that may be useful for the used aircraft may be removed to form the fuselage 102. The fuselage 102 may be generally formed from one of: a truss-based construction, a monocoque construction, a semi-monocoque construction, a geodesic construction, and the like. In an example, the truss-based configuration may force members of the truss to provide a structural stiffness for the fuselage 102, and an aerodynamic covering on the truss may provide a shape of the fuselage 102. However, it may be noted that it does not add much to the overall stiffness of the structure. In another example, the monocoque configuration may refer to a structural arrangement where skins take most of a loading and facilitate optimal structural rigidity for the fuselage 102. In yet another example, the semi-monocoque configuration may encompass both skins and frames and contribute to the overall stiffness of the fuselage 102.

In the design of the fuselage 102, it may be noted that an increase in fuselage diameter from 4 m to 5 m may produce an increase in fuselage profile drag of 60%. Therefore, it may be essential to identify the occupant capacity and corresponding size of the fuselage 102. In an example, it may also be noted that a length of the fuselage 102 should be sized according to a maximum cross-sectional area of the fuselage 102. Typically, the fuselage 102 may have a slenderness ratio (length-to-diameter) of between 5 and 6 to provide a minimum drag.

In certain instances, the fuselage 102 may also include a plurality of windows and doors for the occupants of the fuselage. In an embodiment, the fuselage 102 has a plurality of doors, which may be configured to form a pathway for occupants of the fuselage 102. The plurality of windows and doors may be designed in such a way that the occupants of the fuselage 102 may easily commute to corresponding seats of the fuselage 102. For example, the location of doors and windows on the fuselage 102 may be yet another key consideration during the design of the fuselage 102. The locations of the windows for example may possibly affect the locations of the frames located in a transverse manner in the fuselage 102. The locations of the windows may be decided based on a placement of the frames in the fuselage 102. Additionally, the fuselage 102 may also have a limitation on a number of doors and emergency exits. For example, the type, size, and minimum number of doors and emergency exits that may be located on the fuselage 102 may be generally specified by the regulations published by the Federal Aviation Authority (FAA). In an event of repurposing the fuselage 102, one skilled in the art may retain the same number of doors and emergency exits or modify the number of doors and emergency exits based on user requirements.

The fuselage 102 may also have a plurality of reinforcements proximate to the doors and windows of the fuselage 102. For example, to install the doors and windows in the fuselage 102, there may be a requirement to form cut-outs on the fuselage 102. Such cut-outs may be secured by additional reinforcements to seal such cut-outs after installation of the doors and windows in the fuselage 102. Generally, to avoid such reinforcements, the manufacturer may prefer a minimal and optimal number of doors and windows for the fuselage 102. The design of the fuselage 102 may be optimized for payload, weight, aerodynamic drag and the ability to stretch or shrink in length to accommodate new variations or configurations of the watercraft assembly 100 during its service life that may be held above the waterbody via the plurality of coupling members 104.

The plurality of coupling members 104 may be coupled to the base 102A of the fuselage 102, wherein the plurality of coupling members 104 is equally distributed on opposing sides of the fuselage 102 and each coupling member includes a staircase 104A that may be aligned towards a first axis, which is perpendicular to a longitudinal axis of the fuselage 102. In an embodiment, the fuselage 102 may be permanently coupled with each coupling member of the plurality of coupling members 104. In another embodiment, the fuselage 102 may be removably coupled with each coupling member of the plurality of coupling members 104.

The plurality of coupling members 104 may be coupled to at least one U-shaped connecting member to support a base 102A of the fuselage 102. One end of each coupling member of the plurality of coupling members 104 may be attached to corresponding U-shaped connecting member. The plurality of coupling members 104 may provide a majority of the weight support and dynamic load integrity of cantilever monoplanes, which may be often coupled with the strength of the fuselage 102. In an embodiment, the U-shaped connecting member may be sized to match with the underside of fuselage 102 in order to support the fuselage 102. The plurality of coupling members 104 may generally be configured to couple the fuselage 102 and the plurality of side vessels 106, via the plurality of U-shaped connecting members. Details of the U-shaped connecting member is described further, for example, in FIGS. 3A-3B.

The plurality of coupling members 104 may also include the staircase 104A. The staircase 104A may have a suitable dimension that may substantially confine within a dimension of each coupling member of the plurality of coupling members 104. For example, in case the staircase 104A has a typical height of 4.5 m, length of 12.5 m, and common width between 1.22-1.63 m, the corresponding coupling member of the plurality of coupling members 104 may have a height of 7 m, length of 15 m, and common width between 3 m to 5 m, to accommodate the corresponding staircase.

The plurality of coupling members may include a first coupling member and a second coupling member. The first coupling member may be coupled to a first side of the fuselage 102 and the second coupling member coupled to a second side of the fuselage 102. In an example, the first coupling member may be disposed directly opposite of the second coupling member. The plurality of coupling members 104 may also include two or more coupling components that are termed as multi-spar. Using multiple spars allows for an equivalent overall strength of fuselage 102, but with multiple, smaller, spars, which in turn allow for an increased cost and increased complexity and difficulty of packaging additional equipment (such as fuel tanks, guns, aileron jacks, etc.). The multi-spar design is generally proposed to reduce drag at high speeds of the watercraft assembly 100. The plurality of coupling members 104 may also include a couple of false spars, which may extend spanwise between the multi-spar and are not joined to the fuselage 102. Such false spars may improve structural rigidity of the multi-spar. Each coupling member of the plurality of coupling members 104 may be designed with suitable composite material, such as, Carbon Fiber, Aluminum alloy, or other material, which has a substantially light weight.

The plurality of side vessels 106 coupled to the plurality of coupling members 104, wherein each side vessel of the plurality of side vessels 106 is aligned towards a second axis, which is parallel to the longitudinal axis of the fuselage. Each side vessel of the plurality of side vessels 106 is configured to be disposed on the waterbody and bear a weight of the fuselage 102 above the waterbody, via the plurality of coupling members 104. In an embodiment, the plurality of side vessels 106 may have a buoyant design, which may be configured to improve stability of the fuselage 102.

The plurality of side vessels 106 are weight bearing components of the watercraft assembly 100. Each side vessel rests on one or more coupling member of the plurality of coupling members 104. The side vessel may be formed as a canopy with covered space to form a deck area for additional occupants of the watercraft. It may be necessary to understand that the fuselage 102 of the watercraft assembly 100 has to be above the waterbody (for example, the sea water), where water waves and tides would apply multidirectional uniformed forces on side vessels which will generate random motions and this may introduce the internal stress at variable joints such as base member to side vessels, stairs to doors. In order to mitigate such forces, said joints can be made flexible by using mechanism such bellows, biased hinges etc.

The dimension of each side vessel of the plurality of side vessels 106 may be primarily dependent on the design of the fuselage 102. It may be noted that an increase in the diameter of the side vessel from 1 m to 1.5 m may produce an increase in side vessel profile drag of 40% and corresponding fuselage profile drag of 60%. Therefore, it may be essential to identify the occupant capacity and corresponding size of the fuselage 102 before deciding the dimension of each side vessel of the plurality of side vessels 106. In an example, it may also be noted that a length of the plurality of side vessels 106 may be designed based on the length of the fuselage 102 and such length of the plurality of side vessels 106 may be sized according to a maximum cross-sectional area of the fuselage 102. Typically, the plurality of side vessels 106 may have a slenderness ratio (length-to-diameter) of between 3 and 6 to provide a minimum drag.

In operation, the watercraft assembly 100 may be suspended on the waterbody. The watercraft assembly 100 may include the fuselage 102 that may be extracted from the used aircraft, wherein the fuselage 102 has the base 102A that may be configured to be disposed above the waterbody. The watercraft assembly 100 may further include the plurality of coupling members 104 coupled to the base 102A of the fuselage 102. The plurality of coupling members 104 may be equally distributed on opposing sides of the fuselage 102 and each coupling member includes the staircase 104A that may be aligned towards the first axis, which is perpendicular to the longitudinal axis of the fuselage 102. The watercraft assembly 100 may further include the plurality of side vessels 106 that may be coupled to the plurality of coupling members 104. Each side vessel of the plurality of side vessels 106 may be aligned towards the second axis, which may be parallel to the longitudinal axis of the fuselage 102. Each side vessel of the plurality of side vessels 106 may be configured to be disposed on the waterbody and bear the weight of the fuselage 102 above the waterbody, via the plurality of coupling members 104 that may be coupled to the base 102A of the fuselage 102.

Based on the suspension, the at least one vessel of the plurality of side vessel may be configured to be motorized to maneuver movements of the watercraft assembly 100 on the waterbody. Details of the motorized watercraft assembly is described further, for example, in FIG. 2.

Figure 2:
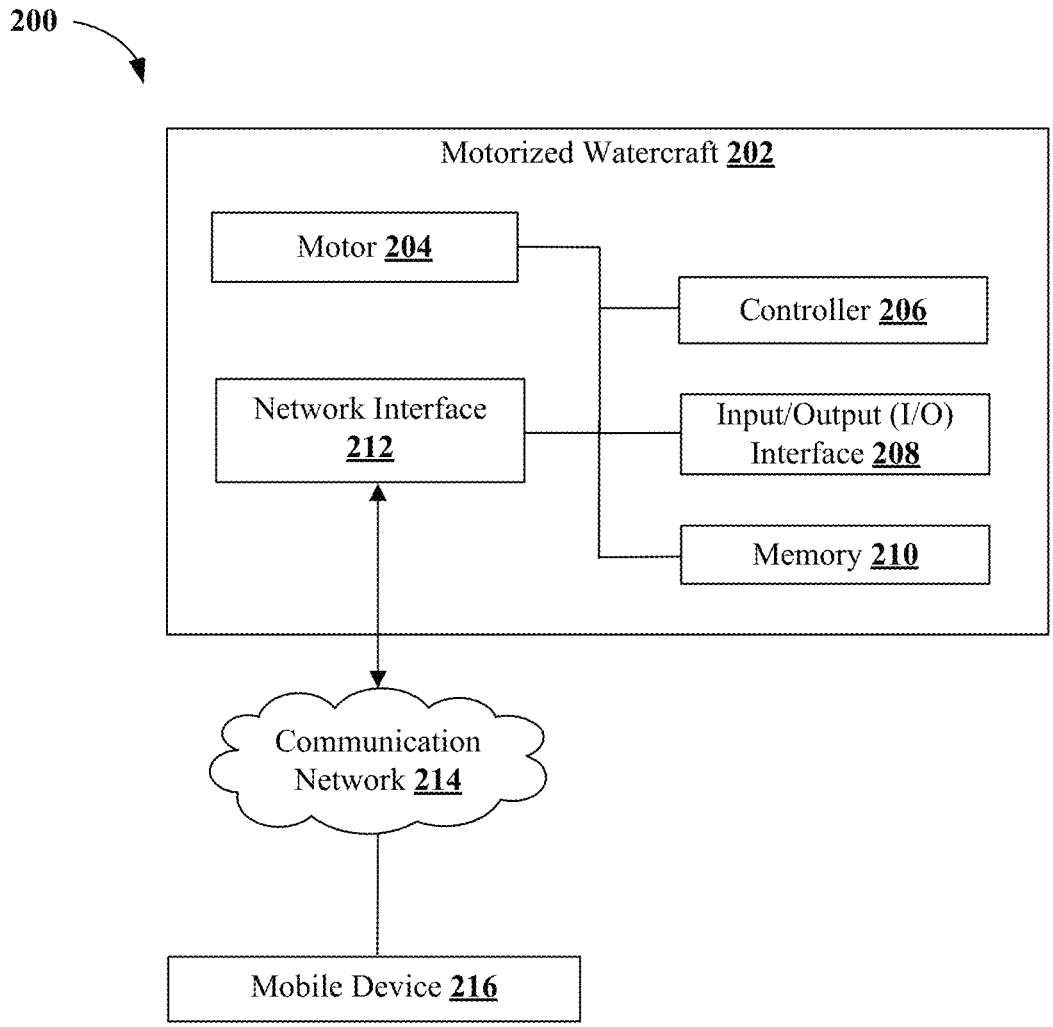
FIG. 2 illustrates a block diagram of a motorized watercraft assembly, in accordance with an embodiment of the present disclosure.

FIG. 2 illustrates a block diagram of a motorized watercraft assembly, in accordance with an embodiment of the present disclosure. FIG. 2 is explained in conjunction with elements from FIG. 1. With reference to FIG. 2, there is shown a block diagram 200 of a motorized watercraft 202. The motorized watercraft 202 may include a motor 204. In an embodiment, each vessel of the plurality of side vessels 106 may be configured to be coupled with the motor 204, to control a maneuverability of the watercraft assembly 100 over the waterbody. The motor 204 may be controlled by a suitable energy resource, which includes at least one of: an electric energy resource, a fossil energy resource, a solar energy resource, or a tidal energy resource.

The motorized watercraft 202 may also include a controller 206, a I/O interface 208, a memory 210, a network interface 212. The motorized watercraft 202 may be communicably coupled with a communication network 214 to communicate with a computing device 216.

The controller 206 may include a suitable, logic, circuitry, interfaces, and/or code that may configured to form one of: a digital controller, an application specific integrated circuit (ASIC), a field programmable gate array (FPGA) or other programmable logic device, discrete gate or transistor logic, discrete hardware components, or any combination thereof designed to perform the functions described herein. The controller 206 can be a microprocessor, but in the alternative, it can be a microcontroller, or the like. Although the embodiments described herein are primarily with respect to digital control unit, the controller 206 may also include primarily analog components. The controller 206 may include capabilities to maneuver movements of the watercraft assembly 100 on the waterbody.

The I/O interface 208 may include suitable logic, circuitry, and interfaces that may be configured to receive an input from the user and provide an output based on the received input. The I/O interface 208 which may include various input and output devices, may be configured to communicate with the controller 206 of the watercraft assembly 100. Examples of the I/O interface 208 may include, but are not limited to, a touch screen, a keyboard, a mouse, a joystick, a microphone, a display device, and a speaker, which may be associated with the components (for example, the fuselage 102, the plurality of coupling members 104, or the plurality of side vessels 106).

The memory 210 may include suitable logic, circuitry, and interfaces that may be configured to store the one or more instructions to be executed by the controller 206 of the motorized watercraft 202. In an embodiment, the memory 210 may be configured to store information associated with maneuvering GPS location and navigation information of the motorized watercraft 202. Based on the maneuvering GPS location and the navigation information, the memory 210 may also store information associated with optimal route plan and speed control for the motorized watercraft 202 and economically save fuel. In another embodiment, the memory 210 may be configured to store pre-set information associated with the comfort level of the occupants of the motorized watercraft 202. For example, in case the occupants prefer cruise mode, the controller 206 may minimize speed of the motor 204 of the motorized watercraft that may be located in at least one side vessel of the plurality of side vessels 106. In another example, in case the occupants prefer sports mode, the controller 206 may maximize the speed of the motor 204 of the motorized watercraft that may be located in at least one side vessel of the plurality of side vessels 106. In yet another example, the controller 206 may also control at least one of: a temperature, a humidity, an airflow rate, or an illumination of the fuselage 102 based on a preference of the occupant. In some examples, the memory (210) may represent any type of non-transitory computer readable medium such as random-access memory (RAM), read only memory (ROM), magnetic disk or tape, optical disk, flash memory, or holographic memory. In an embodiment, the memory 210 may comprise a combination of random-access memory and read only memory and may include data/instructions related to processing of one or more components of the system. In some embodiments, the controller 206 and memory 210 may be combined in a single chip.

The network interface 212 may include suitable logic, circuitry, and interfaces that may facilitate communication between the motorized watercraft 202 and the computing device 216, via the communication network 214. The network interface 212 may be implemented by use of various known technologies to support wired or wireless communication of the motorized watercraft 202 with the communication network 214. The network interface 212 may include, but is not limited to, an antenna, a radio frequency (RF) transceiver, one or more amplifiers, a tuner, one or more oscillators, a digital signal processor, a coder-decoder (CODEC) chipset, a subscriber identity module (SIM) card, or a local buffer circuitry. The network interface 212 may communicate via wireless communication with networks, such as the Internet, an Intranet, or a wireless network, such as a cellular telephone network, a wireless local area network (LAN), and a metropolitan area network (MAN). The wireless communication may be configured to use one or more of a plurality of communication standards, protocols and technologies, such as Global System for Mobile Communications (GSM), Enhanced Data GSM Environment (EDGE), wideband code division multiple access (W-CDMA), Long Term Evolution (LTE), 5th Generation (5G) New Radio (NR), code division multiple access (CDMA), time division multiple access (TDMA), Bluetooth, Wireless Fidelity (Wi-Fi) (such as IEEE 802.11a, IEEE 802.11b, IEEE 802.11g or IEEE 802.11n), voice over Internet Protocol (VoIP), light fidelity (Li-Fi), Worldwide Interoperability for Microwave Access (Wi-MAX), a near field communication protocol, a wireless pear-to-pear protocol, a protocol for email, instant messaging, and a Short Message Service (SMS).

The communication network 214 may include a communication medium through which the motorized watercraft 202 and other devices, such as, the computing device 216 associated with the motorized watercraft 202, may communicate with each other. The communication network 214 may be one of: a wired connection or a wireless connection Examples of the communication network 214 may include, but are not limited to, the Internet, a cloud network, Cellular or Wireless Mobile Network (such as Long-Term Evolution and 5G New Radio), a Wireless Fidelity (Wi-Fi) network, a Personal Area Network (PAN), a Local Area Network (LAN), or a Metropolitan Area Network (MAN), in accordance with various wired and wireless communication protocols. Examples of such wired and wireless communication protocols may include, but are not limited to, at least one of a Transmission Control Protocol and Internet Protocol (TCP/IP), User Datagram Protocol (UDP), Hypertext Transfer Protocol (HTTP), File Transfer Protocol (FTP), Zig Bee, EDGE, IEEE 802.11, light fidelity (Li-Fi), 802.16, IEEE 802.11s, IEEE 802.11g, multi-hop communication, wireless access point (AP), device to device communication, cellular communication protocols, and Bluetooth (BT) communication protocols.

The computing device 216 may include suitable logic, circuitry, and interfaces that may be configured to display graphical and analytical insights of at least one of: a number of occupants in the fuselage 102, an amount of fuel available in the motorized watercraft 202, a speed of the motorized watercraft 202, a mode of movement (for example, eco mode, sports mode, cruise mode) of the motorized watercraft 202, and the like, via the network interface 212 and the communication network 214. Examples of the computing device 216 may include, but are not limited to, a computing device, a smartphone, a cellular phone, a mobile phone, a gaming device, a mainframe machine, a server, a computer workstation, and/or a consumer electronic (CE) device.

Figure 3A:
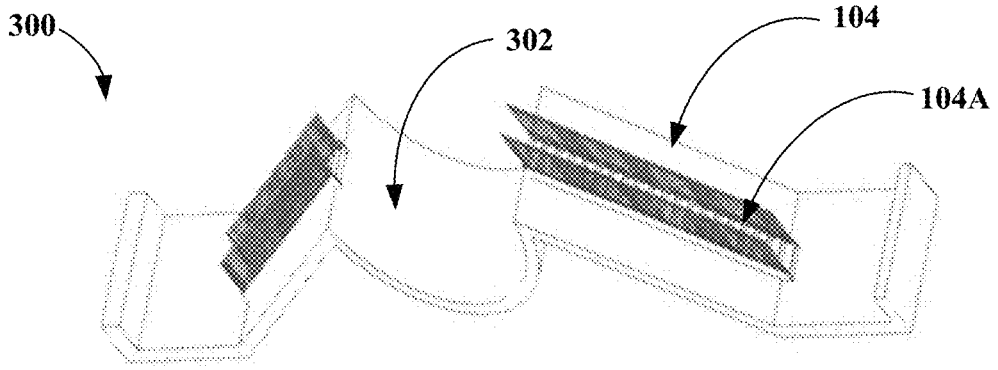
FIGS. 3A-3B illustrates a first exemplary scenario for the watercraft assembly shown in FIG. 1, in accordance with an embodiment of the present disclosure.
Figure 3B:
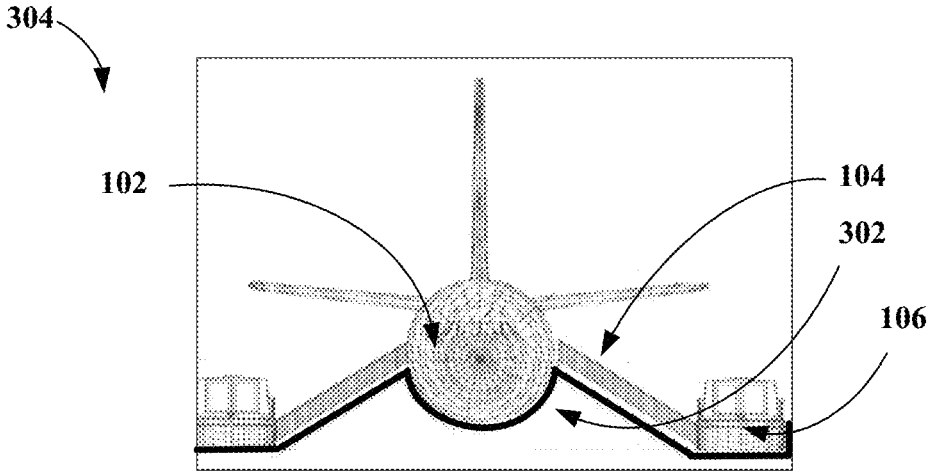

FIGS. 3A-3B illustrates a first exemplary scenario for the watercraft assembly shown in FIG. 1, in accordance with an embodiment of the present disclosure. FIG. 3A is explained in conjunction with elements from FIG. 1 and FIG. 2. With reference to FIG. 3A, there is shown a first exemplary scenario 300 for the watercraft assembly 100. In the first exemplary scenario 300, there is shown a U-shaped connecting member 302. In an embodiment, the fuselage 102 may be supported based on at least one U-shaped connecting member. The U-shaped connecting member 302 may be formed from a suitable material to bear the weight of the fuselage 102. In one example, there may be a single U-shaped connecting member to withstand the weight of the fuselage 102 as a point load. In another example, there may be a plurality of U-shaped connecting members 302 to withstand the weight of the fuselage 102 as a uniformly distributed load.

In an embodiment, each member of the U-shaped connecting member 302 may be coupled to corresponding member of the plurality of coupling members 104, to hold the fuselage 102 above the waterbody. In another embodiment, a single member of the U-shaped connecting member 302 may be coupled to all members of the plurality of coupling members 104, to hold the fuselage 102 above the waterbody. The dimensions of the U-shaped connecting member 302 may be determined based on the dimensions of the plurality of coupling members 104 and the corresponding staircase 104A. For example, the dimensions (such as a height) of the U-shaped connecting member 302 may be less than the dimensions (i.e., the corresponding height) of the corresponding coupling member of the plurality of coupling members 104. In another example, the dimensions (such as a height) of the U-shaped connecting member 302 may be more than the dimensions (i.e., the corresponding height) of the corresponding coupling member of the plurality of coupling members 104. In another embodiment, the dimensions of the U-shaped connecting member 302 may also be determined based on the dimensions of the fuselage 102 of the watercraft assembly 100.

Referring now to FIG. 3B, there is shown an exemplary scenario 304 for the U-shaped connecting member 302 that may be arcuately coupled to the fuselage 102 and the plurality of coupling members 104. In an embodiment, the U-shaped connecting member 302 may also extend to a base of the plurality of side vessels 106 and couple the fuselage 102, the plurality of coupling members 104, and the plurality of side vessels 106, via a unitary connection. In another embodiment, the U-shaped connecting member 302 may also include any other shape, based on the shape of the fuselage 102. Examples of such shapes of the U-shaped connecting member 302 may include, but not limited to, a substantially hexagonal shape, a substantially polygonal shape, and the like. In certain instances, the plurality of side vessels 106 may also include a viewing window for the occupants of the watercraft assembly 100. Details of such viewing window is omitted from the disclosure for the sake of brevity.

Figure 4:
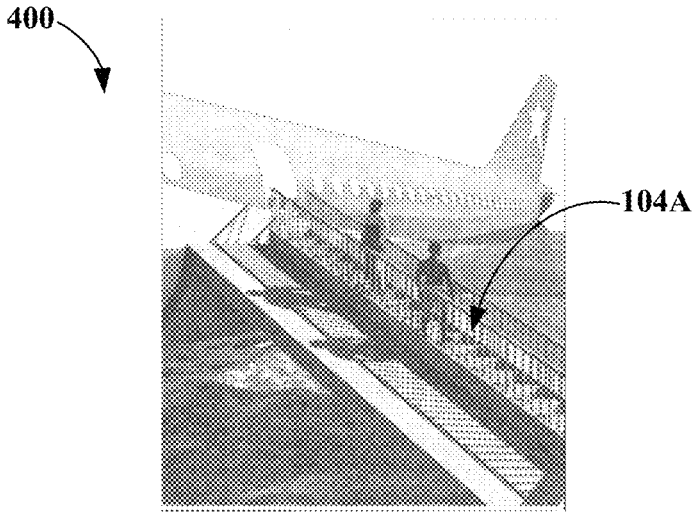
FIG. 4 illustrates a second exemplary scenario for the watercraft assembly shown in FIG. 1, in accordance with an embodiment of the present disclosure.

FIG. 4 illustrates a second exemplary scenario for the watercraft assembly shown in FIG. 1, in accordance with an embodiment of the present disclosure. FIG. 4 is explained in conjunction with elements from FIG. 1, FIG. 2, and FIGS. 3A-3B. With reference to FIG. 4, there is shown a second exemplary scenario 400 for the watercraft assembly 100. In the second exemplary scenario 400, there is shown the staircase 104A associated with the plurality of coupling members 104.

The staircase 104A shown in the second exemplary scenario 400 may be configured to be a moving staircase that may be configured to translate between the fuselage and the side vessels, based on a detection of an occupant on the staircase 104A. For example, the moving staircase may move from the base of the fuselage 102 to the door of the fuselage 102 based on a detection of the occupant adjacent to the base of the fuselage 102. In another example, the moving staircase may move from the door of the fuselage 102 to the base of the fuselage 102, based on a detection of the occupant adjacent to the door of the fuselage 102. The staircase 104A may further include a flat conveyer, which may be configured to support a movement of physically challenged occupants in the fuselage 102.

Figure 5:
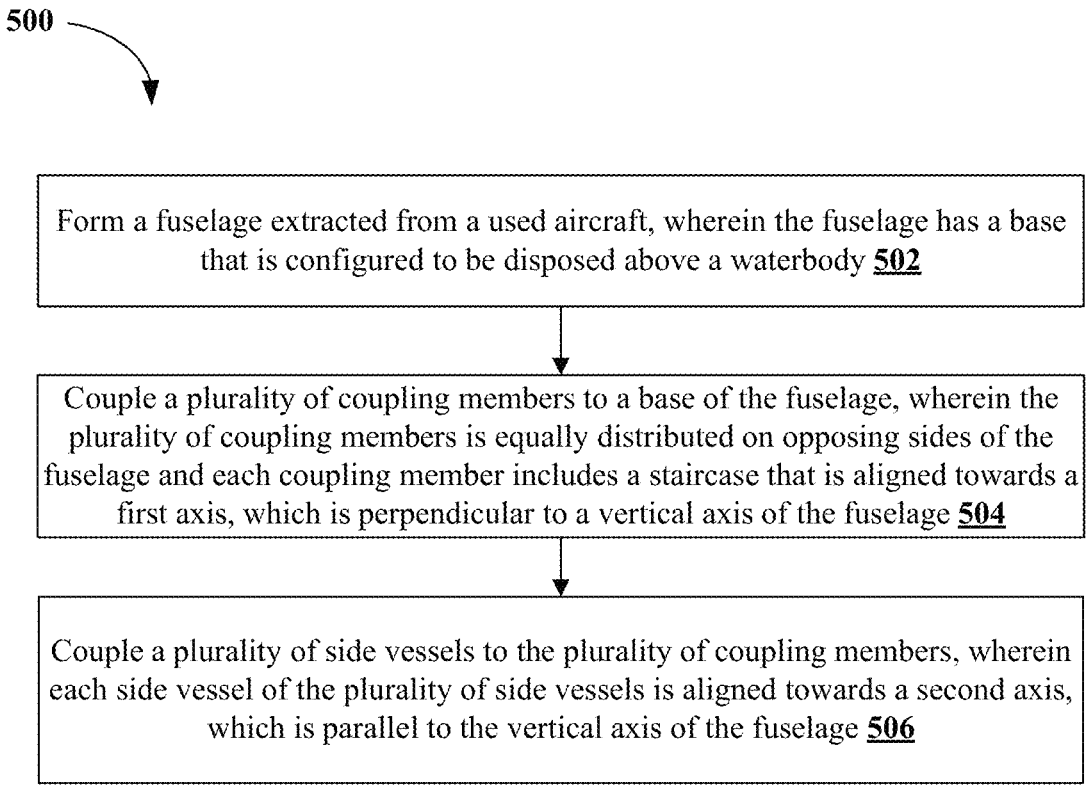
FIG. 5 is a flowchart of a method for forming a watercraft assembly, in accordance with an embodiment of the present disclosure.

FIG. 5 is a flowchart of a method for forming a watercraft assembly, in accordance with an embodiment of the present disclosure. FIG. 5 is explained in conjunction with elements from FIGS. 1, 2, 3A, 3B and 4. With reference to FIG. 5, there is shown a flowchart that depicts a method 500 to form the watercraft assembly 100. Further, for ease of explanation, in the embodiments described below, the method 500 may be implemented by at least one of: the watercraft assembly 100, the motorized watercraft 202, or an operator (not shown) associated with the watercraft assembly 100, as described with reference to FIGS. 1-4. The method 500 illustrated in the flowchart may start from step 502.

At step 502, the fuselage 102 may be formed based on the extraction from the used aircraft, wherein the fuselage 102 has the base 102A that is configured to be disposed above the waterbody. In an embodiment, at least one of: the watercraft assembly 100, the motorized watercraft 202, or the operator associated with the watercraft assembly 100 may form the fuselage, as described, for example in FIGS. 1-4.

At step 504, the plurality of coupling members 104 may be coupled to the base 102A of the fuselage 102, wherein the plurality of coupling members 104 is equally distributed on opposing sides of the fuselage 102 and each coupling member includes the staircase 104A that is aligned towards the first axis, which is perpendicular to the vertical axis of the fuselage 102. In an embodiment, at least one of: the watercraft assembly 100, the motorized watercraft 202, or the operator associated with the watercraft assembly 100 may couple the plurality of coupling members 104 with the fuselage 102, as described, for example in FIGS. 1-4.

At step 506, the plurality of side vessels 106 may be coupled to the plurality of coupling members 104, wherein each side vessel of the plurality of side vessels 106 is aligned towards a second axis, which may be parallel to the vertical axis of the fuselage 102. In an embodiment, at least one of: the watercraft assembly 100, the motorized watercraft 202, or the operator associated with the watercraft assembly 100 may couple the plurality of side vessels 106 with the fuselage 102, as described, for example in FIGS. 1-4.

The order in which the method 500 is described is not intended to be construed as a limitation, and any number of the described method blocks can be combined in any order to implement the method 500 or alternate methods. Additionally, individual blocks may be deleted from the method 500 without departing from the spirit and scope of the subject matter described herein. Furthermore, the method can be implemented in any suitable hardware, software, firmware, or combination thereof.

The illustrated steps are set out to explain the exemplary embodiments shown, and it may be anticipated that ongoing technological development will change the manner in which particular functions are performed. These examples are presented herein for purposes of illustration, and not limitation. Further, the boundaries of the functional building blocks have been arbitrarily defined herein for the convenience of the description. Alternative boundaries can be defined so long as the specified functions and relationships thereof are appropriately performed.

The foregoing method descriptions and the process flow diagrams are provided merely as illustrative examples and are not intended to require or imply that the steps of the various embodiments must be performed in the order presented. As may be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

Various embodiments of the present invention are described with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure may satisfy applicable legal requirements. The term "or" is used herein in both the alternative and conjunctive sense, unless otherwise indicated. The terms "illustrative," "example," and "exemplary" are used to be examples with no indication of quality level. Like numbers refer to like elements throughout.

The phrases "in an embodiment," "in one embodiment," "according to one embodiment," and the like generally mean that the feature, structure, or characteristic following the phrase may be included in at least one embodiment of the present disclosure and may be included in more than one embodiment of the present disclosure (importantly, such phrases do not necessarily refer to the same embodiment).

The word "exemplary" is used herein to mean "serving as an example, instance, or illustration." Any implementation described herein as "exemplary" is not necessarily to be construed as preferred or advantageous over other implementations.

If the specification states a component or feature "can," "may," "could," "should," "would," "preferably," "possibly," "typically," "optionally," "for example," "often," or "might" (or other such language) be included or have a characteristic, that component or feature is not required to be included or to have the characteristic. Such component or feature may be optionally included in some embodiments, or it may be excluded.

In some example embodiments, certain ones of the operations herein may be modified or further amplified as described below. Moreover, in some embodiments additional optional operations may also be included. It should be appreciated that each of the modifications, optional additions or amplifications described herein may be included with the operations herein either alone or in combination with any others among the features described herein.

The hardware used to implement the various illustrative logics, logical blocks, modules, and circuits described in connection with the aspects disclosed herein may include a general purpose processor, a digital signal processor (DSP), a special-purpose processor such as an application specific integrated circuit (ASIC) or a field programmable gate array (FPGA), a programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively, or additionally, some steps or methods may be performed by circuitry that is specific to a given function.

In one or more example embodiments, the functions described herein may be implemented by special-purpose hardware or a combination of hardware programmed by firmware or other software. In implementations relying on firmware or other software, the functions may be performed as a result of execution of one or more instructions stored on one or more non-transitory computer-readable media and/or one or more non-transitory processor-readable media. These instructions may be embodied by one or more processor-executable software modules that reside on the one or more non-transitory computer-readable or processor-readable storage media. Non-transitory computer-readable or processor-readable storage media may in this regard comprise any storage media that may be accessed by a computer or a processor. By way of example but not limitation, such non-transitory computer-readable or processor-readable media may include random access memory (RAM), read-only memory (ROM), electrically erasable programmable read-only memory (EEPROM), FLASH memory, disk storage, magnetic storage devices, or the like. Disk storage, as used herein, includes compact disc (CD), laser disc, optical disc, digital versatile disc (DVD), floppy disk, and Blu-ray disc™, or other storage devices that store data magnetically or optically with lasers. Combinations of the above types of media are also included within the scope of the terms non-transitory computer-readable and processor-readable media. Additionally, any combination of instructions stored on the one or more non-transitory processor-readable or computer-readable media may be referred to herein as a computer program product.

Many modifications and other embodiments of the inventions set forth herein will come to mind to one skilled in the art to which these inventions pertain having the benefit of teachings presented in the foregoing descriptions and the associated drawings. Although the figures only show certain components of the apparatus and systems described herein, it is understood that various other components may be used in conjunction with the supply management system. Therefore, it is to be understood that the inventions are not to be limited to the specific embodiments disclosed and that modifications and other embodiments are intended to be included within the scope of the appended claims. Moreover, the steps in the method described above may not necessarily occur in the order depicted in the accompanying diagrams, and in some cases one or more of the steps depicted may occur substantially simultaneously, or additional steps may be involved. Although specific terms are employed herein, they are used in a generic and descriptive sense only and not for purposes of limitation.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

I claim:

1. A watercraft assembly, comprising:

a fuselage extracted from a used aircraft, wherein the fuselage has a base that is configured to be disposed above a waterbody;

a plurality of coupling members coupled to the base of the fuselage, wherein the plurality of coupling members is equally distributed on opposing sides of the fuselage and each coupling member includes a staircase that is aligned towards a first axis, which is perpendicular to a longitudinal axis of the fuselage; and a plurality of side vessels coupled to the plurality of coupling members, wherein each side vessel of the plurality of side vessels is aligned towards a second axis, which is parallel to the longitudinal axis of the fuselage, wherein, each side vessel of the plurality of side vessels is configured to be disposed on the waterbody and bear a weight of the fuselage above the waterbody, via the plurality of coupling members.

2. The watercraft assembly according to claim 1, wherein fuselage is supported based on at least one U-shaped connecting member.

3. The watercraft assembly according to claim 1, wherein the plurality of coupling members comprises a first coupling member and a second coupling member, wherein the first coupling member is coupled to a first side of the fuselage and the second coupling member coupled to a second side of the fuselage.

4. The watercraft assembly according to claim 3, wherein first coupling member is disposed directly opposite of the second coupling member.

5. The watercraft assembly according to claim 1, wherein the base of the fuselage is coated with a rust resistance coating material.

6. The watercraft assembly according to claim 1, wherein the plurality of side vessels has a buoyant design, which is configured to improve stability of the fuselage.

7. The watercraft assembly according to claim 1, wherein each vessel of the plurality of side vessels is configured to be coupled with a motor, to control a maneuverability of the fuselage over the waterbody.

8. The watercraft assembly according to claim 7, wherein the motor may be controlled by an energy resource, which includes at least one of: an electric energy resource, a fossil energy resource, a solar energy resource, or a tidal energy resource.

9. The watercraft assembly according to claim 1, wherein the fuselage is permanently coupled with each coupling member of the plurality of coupling members.

10. The watercraft assembly according to claim 1, wherein the fuselage is removably coupled with each coupling member of the plurality of coupling members.

11. The watercraft assembly according to claim 1, wherein the fuselage is disposed at a first height from a base level of the waterbody.

12. The watercraft assembly according to claim 1, wherein the fuselage has a plurality of doors, which are configured to form a pathway for occupants of the fuselage.

13. The watercraft assembly according to claim 1, wherein the fuselage comprises a seating arrangement to accommodate occupants in the fuselage.

14. The watercraft assembly according to claim 13, wherein the fuselage comprises a vacant space in addition to the seating arrangement to accommodate movement of the occupants in the fuselage.

15. The watercraft assembly according to claim 1, wherein the staircase is a moveable staircase, which is configured to translate between the fuselage and the side vessels, based on a detection of an occupant on the staircase.

16. The watercraft assembly according to claim 1, wherein the staircase further comprises a flat conveyer, which is configured to support a movement of physically challenged occupants in the fuselage.

17. A watercraft assembly, comprising:

a fuselage extracted from a used aircraft, wherein the fuselage has a base that is configured to be disposed above a waterbody;

a plurality of coupling members coupled to a base of the fuselage, wherein the plurality of coupling members is equally distributed on opposing sides of the fuselage and each coupling member includes a staircase that is aligned towards a first axis, which is perpendicular to a vertical axis of the fuselage; and a plurality of side vessels coupled to the plurality of coupling members, wherein each side vessel of the plurality of side vessels is aligned towards a second axis, which is parallel to the vertical axis of the fuselage.

18. The watercraft assembly according to claim 17, wherein each vessel of the plurality of side vessels is configured to be coupled with a motor, to control a maneuverability of the fuselage on the waterbody.

19. The watercraft assembly according to claim 18, wherein the motor may be controlled by an energy resource, which includes at least one of: an electric energy resource, a fossil energy resource, a solar energy resource, or a tidal energy resource.

20. A method to form watercraft assembly, the method comprising:

forming a fuselage extracted from a used aircraft, wherein the fuselage has a base that is configured to be disposed above a waterbody;

coupling a plurality of coupling members to a base of the fuselage, wherein the plurality of coupling members is equally distributed on opposing sides of the fuselage and each coupling member includes a staircase that is aligned towards a first axis, which is perpendicular to a vertical axis of the fuselage; and coupling a plurality of side vessels to the plurality of coupling members, wherein each side vessel of the plurality of side vessels is aligned towards a second axis, which is parallel to the vertical axis of the fuselage.

* * * * *